United States Patent [19]

Heki et al.

[11] Patent Number: 4,970,140

[45] Date of Patent: Nov. 13, 1990

[54] DIRECT POSITIVE PHOTOGRAPHIC LIGHT-SENSITIVE MATERIAL

[75] Inventors: Tatsuo Heki; Tetsuo Yoshida, both of Minami-ashigara, Japan

[73] Assignee: Fuji Photo Film Co., Ltd., Kanagawa, Japan

[21] Appl. No.: 242,978

[22] Filed: Sep. 12, 1988

Related U.S. Application Data

[63] Continuation-in-part of Ser. No. 16,669, Feb. 19, 1987, abandoned.

[30] Foreign Application Priority Data

Feb. 20, 1986 [JP] Japan ..... 61-36422
Apr. 17, 1986 [JP] Japan ..... 61-88626

[51] Int. Cl.[5] ..... G03C 1/46; G03C 1/485

[52] U.S. Cl. ..... 430/502; 430/409; 430/410; 430/506; 430/509; 430/547; 430/567; 430/569

[58] Field of Search ..... 430/502, 547, 567, 569, 430/409, 410, 506, 509

[56] References Cited

U.S. PATENT DOCUMENTS

| | | | |
|---|---|---|---|
| 2,350,380 | 8/1940 | White | 430/502 |
| 2,397,452 | 11/1943 | White | 430/506 |
| 3,501,305 | 3/1970 | Illingsworth | 430/567 |
| 3,843,369 | 10/1974 | Kamai et al. | 430/506 |
| 4,045,228 | 8/1977 | Vanassche et al. | 430/567 |
| 4,186,016 | 1/1980 | Lohmann et al. | 430/506 |
| 4,608,334 | 8/1986 | Shuto et al. | 430/509 |
| 4,613,563 | 9/1986 | Murai | 430/506 |
| 4,643,965 | 2/1987 | Kubota et al. | 430/409 |

FOREIGN PATENT DOCUMENTS

| | | | |
|---|---|---|---|
| 2044944 | 10/1980 | United Kingdom | 430/567 |

*Primary Examiner*—Paul R. Michl
*Assistant Examiner*—Thorl Chea
*Attorney, Agent, or Firm*—Burns, Doane, Swecker & Mathis

[57] ABSTRACT

A direct positive photographic light-sensitive material is disclosed which comprises at least two direct positive emulsion layers having the same color sensitivity, wherein at least one hydrophilic colloid layer is provided between the direct positive emulsion layers. A direct positive photographic light-sensitive material having a high graininess, a soft tone, and a high picture quality can be obtained.

16 Claims, No Drawings

DIRECT POSITIVE PHOTOGRAPHIC LIGHT-SENSITIVE MATERIAL

This application is a Continuation-In-Part application of U.S. Patent application No. 016,669, filed Feb. 19, 1987 now abandoned.

BACKGROUND OF THE INVENTION

The present invention relates to a direct positive photographic light-sensitive material. In particular, the present invention relates to a direct positive photographic light-sensitive material which has a high granularity, a soft tone, and a high picture quality.

It is known that a reversed image can be obtained by a process which comprises developing internal latent image-type silver halide grains each composed of (a) a silver halide core which has been doped with a metal ion and/or chemically sensitized, and (b) a silver halide shell covering at least a sensitive site of the core, the shell surface being, if necessary, chemically sensitized and, (b) a silver halide shell covering at least a sensitive site of the core, the shell surface being, if necessary, chemically sensitized (these grains are hereinafter referred to as "core/shell-type grain"), in the presence of a fogging agent, or according to a direct reversal process wherein the development is conducted under overall light exposure. Such a process is described in U.S. Pat. Nos. 3,317,322 and 3,761,276.

Such a core/shell type silver halide emulsion has a drawback in that the gradation is hard and a sensitive material capable of realizing a soft tone and a high picture quality cannot be obtained therefrom, because the emulsion is of a monodisperse system. It is known that such a defect can be overcome to some extent by forming a layer of a mixture of emulsions having the same color sensitivity but different sensitivities, or by arranging those emulsions in two layers as disclosed in Japanese Patent Public Disclosure No. 56142531.

The use of a silver halide photographic light-sensitive material having two layers comprising the core/shell-type silver halide grains as described above provides an excellent reversed photographic property with respect to a gradation. However, there is a drawback in that other photographic properties such as a granularity and black spot inhibition are poor. Supposedly, when two kinds of emulsion layers are formed so as to obtain a soft tone, the development of the emulsion layer of higher sensitivity induces the development of the emulsion layer of lower sensitivity. This will seriously damage the granularity.

Further, when several kinds of emulsions are prepared by using the same apparatus, a direct positive emulsion having a higher sensitivity happens to be contaminated by a negative emulsion and, therefore, an emulsion having a lower sensitivity is influenced by the contamination of the negative emulsion even though the operation is carefully conducted so as to prevent the contamination with the negative emulsion. As a result, spots, namely, black spots are formed and seriously damage the picture quality.

The term "black spot" as used herein indicates those formed on a portion where the density must be uniform. They are also called "black pepper". In a color photosensitive material, the spots have colors such as yellow, magenta and cyan depending on the emulsion layer formed.

These defects can be overcome by modifying the developability of the emulsion of higher sensitivity, or by preparing this emulsion carefully so as to avoid the contamination thereof with the negative emulsion. However, other photographic properties are seriously modified in the former method, while the production cost is increased in the latter method.

SUMMARY OF THE INVENTION

Accordingly, an object of the present invention is to provide a direct positive photographic light-sensitive material free of these defects, having excellent photographic properties and capable of providing a high picture quality.

Another object of this invention is to provide a direct positive photographic light-sensitive material having a good granularity and capable of providing a soft tone (a wide exposure latitude).

In order to resolve the above noted problems and achieve the above objects, the present inventors have made intensive studies and unexpectedly found that the above problems can be resolved by using at least two direct positive emulsion layers having the same color sensitivity in a direct positive photosensitive material, while at least one hydrophilic colloid layer is provided between those emulsion layers. That is, the above-described objects of the invention can be attained by a direct positive photographic light-sensitive material comprising, on a support, at least two previously unfogged internal latent image-type direct positive emulsion layers having the same color sensitivity wherein at least one hydrophilic colloid layer containing a binder is provided between the emulsion layers, and wherein the hydrophilic colloid layer is not a previously unfogged internal latent image-type direct positive layer which contains smaller size grains.

DETAILED DESCRIPTION OF THE PREFERRED EMBODIMENTS

The direct positive emulsions used in the present invention are those known in the art. More particularly, those mentioned in RESEARCH DISCLOSURE, 176, Item 17643 I, p. 22 (December, 1978); and 192, Item 19227, pp. 155 to 156 (April, 1980) can be used. In the present invention, a direct positive emulsion such as core/shell-type emulsions and conversion-type emulsions (described in, for example, U.S. Pat. No. 2,592,250) can be used.

Among them, core/shell-type silver halide emulsion having an internal latent image is preferred in the present invention.

The silver halide grains used in this invention are preferably of a monodisperse system and the average grain diameter is preferably about 0.1 to 4 μm, particularly about 0.2 to 3 μm, so as to obtain effective results. The term "monodisperse grains" as used herein indicates that the silver halide grains in the emulsion have substantially a uniform diameter. Preferably, about 95% of the silver halide grains according to this invention have a diameter within the average grain diameter ±40%, preferably within the average grain diameter ±30%. To obtain a wider exposure latitude, it is desirable that an emulsion layer comprising the core/shell type silver halide grains having a smaller average grain size is placed closely to a support to form the bottom layer, and an emulsion layer comprising core/shell type silver halide grains having a larger average size is placed remotely from the support. The average diameter of the smaller grains is preferably 0.1 to 0.5 μm and that of the larger grains is 0.5 to 1.7 μm. It is preferable that the sensitivity difference between the upper and lower emulsion layers is 0.2 to 0.5 as a unit log E. Further, two or more kinds of core/shell-type silver halide grains having different average diameters can be used in the same layer.

Now, a description will be made of the hydrophilic colloid layer (intermediate layer) interposed between the direct positive emulsion layers constituting the photo sensitive material of the present invention.

Gelatin or another water-soluble polymer is preferably used as a binder for a hydrophilic colloid layer (intermediate layer) to be interposed between the two emulsion layers. Examples of the binders will be given below. The amount of the binder to be coated is preferably 0.05 to 2 g/m$^2$, particularly 0.1 to 0.5 g/m$^2$.

The intermediate layer may or may not contain silver halide grains. However, it is preferable that the layer contains the silver halide grains and in such a case, the layer contains preferably 0.1 to 2.0 g-Ag/m$^2$ of silver halide grains.

The emulsion to be contained in the intermediate layer may be either negative or positive emulsion. The positive one is preferred. The negative emulsion may be chemically sensitized, if necessary. The optimum sensitivity ranges of those emulsions are variable. The range can be easily selected by those skilled in the art.

When the intermediate layer comprises a negative emulsion, the sensitivity thereof is preferably lower than even that of the direct positive emulsion (such as emulsion of core/shell-type silver halide grains having a smaller grain size) having a lower sensitivity by a Δlog E of at least 2.0. Such a negative emulsion can be prepared by controlling its grain size to 0.05 μm or less, or by not chemically sensitizing the same.

The intermediate layer of the present invention may comprise either a single layer or two or more layers.

When the intermediate layer comprises a positive emulsion, (1) the sensitivity (Δlog E) thereof is preferably higher than even that of the direct positive emulsion (such as emulsion of core/shell-type silver halide grains having a larger grain size) having a higher sensitivity by at least 2.0 or, alternatively, (2) the sensitivity thereof is preferably between that of the direct positive emulsion (such as core/shell-type silver halide grain emulsion) having a smaller average grain size and that of the direct positive emulsion having a larger average grain size. The latter case (2) or an intermediate sensitivity emulsion is preferred to the former case (1).

Now, a detailed description will be made of the direct positive emulsion, particularly, the core/shell-type silver halide emulsion, constituting the direct positive photographic light-sensitive material of the present invention.

The core/shell-type silver halide grains are prepared by forming silver halide cores which are doped with a metal ion and/or chemically sensitized, then coating the surfaces of the grains with a silver halide to form shells and, if necessary, chemically sensitizing the shells. It is unnecessary to coat the whole surface of the core with the shell. It is sufficient to coat at least a sensitive site (a site in which silver is formed by the photolysis caused by the exposure) of the core. The core can be doped with a metal ion by, for example, forming or physically aging the silver halide core in the presence of a metal ion source such as a cadmium salt, zinc salt, lead salt, thallium salt, iridium salt or its complex salt, rhodium salt or its complex salt, or iron salt or its complex salt.

The metal ion is usually used in an amount of at least $10^{-8}$ mol per mol of the silver halide. The core-forming silver halide can be chemically sensitized with one or more of noble metal sensitizers, sulfur sensitizers and reduction sensitizers in place of or in combination with the doping with the metal ion. The sensitivity is increased particularly when the gold sensitization and sulfur sensitization are made. Processes for the treatment of the core-forming silver halide and for coating the core-forming silver halide grain surface with the shellforming silver halide, have been well known. For example, processes disclosed in U.S. Pat. Nos. 3,206,316, 3,317,322, 3,367,778 (excluding the step of fogging the grain surface) and 3,761,276 can be employed advantageously.

The relative amounts of the core-forming silver halide and the shell-forming silver halide are not particularly limited but usually the molar ratio of the former to the latter is ½ to ⅛.

The core-forming silver halide may be the same as or different from the shell-forming silver halide. However, it is preferable that they are the same. Examples of the silver halide used in this invention include silver bromide, iodide, chloride, chlorobromide, bromoiodide and chlorobromoiodide. Among them, silver bromide is particularly preferred.

The core/shell silver halide grains may be in a regular crystal form such as cubic, octahedral, tetradecahedral or rhombo-tetradecahedral form; an irregular crystal form such as spherical or plate form; a composite crystal form thereof; or a mixture of various crystal forms.

The surfaces of the thus prepared core/shell-type silver halide grains can be chemically sensitized, if necessary.

The chemical sensitization of the core/shell-type silver halide grain surface is conducted by a known process such as that disclosed in Glafkides "Chimie et Physique Photographique" (published by Paul Montel Co. in 1967), V. L. Zelikman et al. "Making and Coating Photographic Emulsion" (published by The Focal Press Co. in 1964), or "Die Grundlagen der Photographischen Prozesse mit Silberhalogeniden" edited by H. Frieser (published by Akademische Verlagsgesellschaft in 1968).

More particularly, chemical sensitization can be conducted by a sulfur sensitization process wherein a sulfur-containing compound reactive with silver and active gelatin are used, a reduction sensitization process wherein a reducing substance is used, and a noble metal sensitization process wherein gold or another noble metal compound is used. These processes may be employed either singly or as a combination thereof. The most preferred results are obtained when a combination of the gold sensitization process with the sulfur sensitization process is employed reduction sensitization process may be combined with those processes, if necessary. The sulfur sensitizers include thiosulfates, thioureas, thiazoles, rhodanines, etc. Examples of the sulfur sensitizers are mentioned in U.S. Pat. Nos. 1,574,944, 2,410,689, 2,278,947, 2,728,668 and 3,656,955. The reduction sensitizers include stannous salts, amines, hydrazine derivatives, formamidinesulfinic acid, silane compounds, etc. Examples of them are mentioned in U.S. Pat. Nos. 2,487,850, 2,419,974, 2,518,698, 2,983,609, 2,983,610 and 2,694,637. The noble metal sensitizers include, as well as gold complex salts, complex salts of metals in Group VIII in the Periodic Table such as platinum, iridium and palladium. Examples of them are mentioned in U.S. Pat. Nos. 2,399,083 and 2,448,060, and British Patent No. 618,061.

The conditions of the chemical sensitization are optional. In general, the chemical sensitization can be conducted under conditions that a pH is 8 or less, pAg is 10 or less and temperature is 40° C. or above, to obtain satisfactory results. If necessary, conditions beyond the above ranges can also be employed. The core/shell-type silver halide grain surface is chemically sensitized in such a manner that the properties of internal latent image-type grains are not damaged as a matter of course. The term "properties of the internal latent image-type grain" herein means that when the silver halide emulsion is applied to a transparent base, then exposed for a given time of 0.01 to 10 sec and developed in the following developer A (internal-type developer) at 20° C. for 3 min., the maximum density of the image thus formed and determined by an ordinary photographic density measuring method is at least 5 times as high as that obtained by developing the exposed sample having the same silver halide emulsion in the following developer B (surface-type developer) at 20° C. for 4 min:

| | |
|---|---|
| Developer A: | |
| hydroquinone | 15 g |
| monomethyl-p-aminophenol sesquisulfate | 15 g |
| sodium sulfite | 50 g |
| potassium bromide | 10 g |
| sodium hydroxide | 25 g |
| sodium thiosulfate | 20 g |
| water ad | 1 l |
| Developer B: | |
| p-hydroxyphenylglycine | 10 g |
| sodium carbonate | 100 g |
| water ad | 1 l |

The core/shell-type silver halide grains are dispersed in the binder as is well known in the art.

Gelatin is used as the binder for both the direct positive silver halide emulsion and the intermediate layer. In addition, other hydrophilic colloids can be used.

The suitable hydrophilic colloids include, for example, proteins such as gelatin derivatives, graft polymers of gelatin and another polymer, albumin and casein; cellulose derivatives such as hydroxyethylcellulose, carboxymethylcellulose and cellulose sulfates; and sugar derivatives such as sodium alginate and starch derivatives.

The gelatin usable herein includes those treated with lime or an acid and gelatins treated with an enzyme as described in Bull. Soc. Sci. Phot., Japan, No. 16, p. 30 (1966) as well as hydrolyzates and enzymatic decomposition products thereof. The gelatin derivatives include those formed by reacting gelatin with, for example, an acid halide, isocyanate, bromoacetic acid, alkanesultone, vinylsulfonamide, maleimide, polyalkylene oxide or epoxy compound.

The internal latent image-type silver halide photographic emulsion to be used in this invention may be spectrally sensitized with a methine dye or the like. The dyes usable for this purpose include cyanine, merocyanine, complex cyanine, complex merocyanine, holopolar cyanine, hemicyanine, styryl and hemioxonol dyes. Particularly useful dyes are cyanine, merocyanine and complex merocyanine dyes. These dyes may have any of nuclei which are used for cyanine dyes as basic heterocyclic nuclei. Examples of the nuclei include pyrroline, oxazoline, thiazoline, pyrrole, oxazole, thiazole, selenazole, imidazole, tetrazole and pyridine nuclei; these nuclei fused with an alicyclic hydrocarbon ring or an aromatic hydrocarbon ring such as indolenine, benzindolenine, indole, benzoxazole, naphthoxazole, benzothiazole, naphthothiazole, benzoselenazole, benzimidazole and quinoline nuclei. These nuclei may have 1 substituent bonded with the carbon atom.

The merocyanine or complex merocyanine dyes may have a 5 or 6-membered heterocyclic nucleus having a ketomethylene structure such as pyrazoline-5-on, thiohydantoin, 2-thiooxazolidine-2,4-dion, thiazolidine-2,4-dion, rhodanine or thiobarbituric acid nucleus.

The emulsion may contain, in addition to the sensitizing dye, a dye which per se provides no spectral sensitization effect or a supersensitizing substance which substantially does not absorb visible rays. The emulsion may include, for example, aminostilbene compounds substituted with a nitrogen containing heterocyclic group (such as those mentioned in U.S. Pat. Nos. 2,933,390 and 3,635,721), aromatic organic acid/formaldehyde condensates (such as those mentioned in U.S. Pat. No. 3,743,510), cadmium salts, and azaindene compounds. Combinations mentioned in U.S. Pat. Nos. 3,615,613, 3,615,641, 3,617,295 and 3,635,721 are particularly effective.

Supports to be used herein are those mentioned in Research Disclosure, Vol. 176 (1978, XII), RD-17643, Paragraph [XVII].

To increase the sensitivity and contrast or to accelerate the development, the following additives may be added to the internal latent image-type silver halide photographic emulsion of this invention: polyalkylene oxides and their derivatives such as ethers, esters and amines; thioether compounds, thiomorpholines, quaternary ammonium salts, urethane derivatives, urea derivatives, imidazole derivatives, 3pyrazolidones, etc. For example, those mentioned in U.S. Pat. Nos. 2,400,532, 2,423,549, 2,716,062, 3,617,280, 3,772,021 and 3,808,003 can be used.

The internal latent image-type silver halide photographic emulsion of this invention may contain an antifoggant and a stabilizer. These antifoggants and stabilizers are mentioned in Research Disclosure, Vol. 176 (1978, XII), RD-17643, Paragraph [VI].

The internal latent image-type silver halide photographic emulsion of this invention may contain a developing agent. The developing agents include those mentioned in Research Disclosure, Vol. 176 (1978, XII) RD-17643, Paragraph [XX].

The internal latent image-type silver halide photographic emulsion of this invention can be dispersed in a colloid which can be hardened with various organic or inorganic hardeners. The hardeners are those mentioned in Research Disclosure, Vol. 176 (1978, XII), RD-17643, Paragraph [X].

The internal latent image-type silver halide photographic emulsion of this invention can contain a coating aid. The coating aids are those mentioned in Research Disclosure, Vol. 176 (1978, XII) RD-17643, Paragraph [XI].

The internal latent image-type silver halide photographic emulsion of this invention may contain a so called color coupler and can be used for the preparation of a direct positive color sensitive material. The color couplers are mentioned in Research Disclosure, Vol. 176 (1978, XII) RD-17643, Paragraph [VII].

The internal latent image-type silver halide photographic emulsion of this invention may contain further, an antistatic agent, plasticizer, matting agent, lubricant, U.V. absorber, fluorescent brightening agent, aerial antifoggant, etc.

The photographic emulsion layer or another hydrophilic colloid layer of the sensitive materials prepared from the internal latent image-type silver halide photographic emulsion of this invention may contain a dye effective as a filter dye or anti-irradiation dye or for various other purposes. The dyes are those mentioned in Research Disclosure, Vol. 176 (1978, XII), RD-17643, Paragraph [VII].

The internal latent image-type silver halide photographic emulsion of this invention is developed in the presence of a fogging agent (nucleating agent) or under overall light exposure, to form a reversal image. Typical examples of the fogging agents usable herein include hydrazines mentioned in U.S. Pat. Nos. 2,588,982 and 2,563,785; hydrazides and hydrazones mentioned in U.S. Pat. No. 3,227,552; quaternary salts mentioned in British Patent No. 1,283,835, Japanese Patent Publication No. 49-38164 and U.S. Pat. Nos. 3,615,615, 3,719,494, 3,734,738, 4,094,683 and 4,115,122; sensitizing dyes having a nucleating substituent (having a fogging effect), in the molecule as mentioned in U.S. Pat. No. 3,718,470; acylhydrazinophenylthiourea compounds mentioned in U.S. Pat. Nos. 4,030,925 and 4,031,127; and acylhydrazinophenylurea compounds mentioned in Japanese Patent Public Disclosure No. 57-86829. The fogging agents include further compounds mentioned in U.S. Pat. No. 4,139,387 and Japanese Patent Public Disclosure Nos. 54-133126 and 54-74729.

The fogging agent is desirably used in such an amount that a sufficient maximum density is obtained when the internal latent image-type silver halide emulsion of the present invention is developed with a surface developer. The fogging agent is preferably incorporated in the photographic emulsion layer or its adjacent layer.

In another embodiment, no fogging agent is used and the overall light exposure is conducted in the course of the treatment.

The negative emulsions to be used in the present invention are those described in Research Disclosure, Vol. 176, Item 17643, Paragraph I, p. 22 (December, 1978).

The photographic light-sensitive materials to which the present invention is applicable include B/W direct positive photographic light-sensitive materials disclosed in Japanese Patent Public Disclosure Nos. 59-208540 and 60-260039 (such as X-ray photosensitive materials, dupe photosensitive materials, micrographic photosensitive materials, photocomposition photosensitive materials and printing photosensitive materials); color direct positive photographic sensitive materials using a coupler described in Japanese Patent Public Disclosure No. 58-70233 (such as color papers and color photography photosensitive materials); and color diffusion transfer direct positive photosensitive materials described in Research Disclosure, Vol. 151, No. 15162, pp. 75 to 87 (November, 1976).

The photosensitive material of the present invention, is developed using various known developers. Examples of the developers include polyhydroxybenzenes such as hydroquinone, 2-chlorohydroquinone, 2-methylhydroquinone, catechol and pyrogallol; aminophenols such as p-aminophenol, N-methyl-p-aminophenol and 2,4-diaminophenol; 3-pyrazolidones such as 1-phenyl-3-pyrazolidones, 1-phenyl-4,4'-dimethyl-3-pyrazolidone, 1-phenyl-4-methyl-4-hydroxymethyl-3-pyrazolidone and 5,5-dimethyl-1-phenyl-3-pyrazolidone; and ascorbic acids. They may be used singly or as a combination thereof. Further, developers mentioned in Japanese Patent Application No. 56154116 can also be used. For obtaining a dye image in the presence of a dye-forming coupler, aromatic primary amine developers, preferably p-phenylenediamine developers, can be used. They include, for example, 4-amino-3-methyl-N,N-diethylaniline hydrochloride, N,N-diethyl-p-phenylenediamine, 3-methyl-4-amino-N-ethyl-N-β-(methanesulfoamido)ethylaniline, 3-methyl-4-amino-N-ethyl-N-(β-sulfoethyl)aniline, 3-ethoxy-4-amino-N-ethyl-N-(β-sulfoethyl)aniline and 4-amino-N-ethyl-N-(β-hydroxyethyl)aniline. These developers may be present in an alkaline processing composition (processing element) or in a suitable photosensitive element layer.

The developer may contain a preservative such as sodium sulfite, potassium sulfite, ascorbic acid or a reductone (e.g. piperidinohexose reductone).

A positive image can be formed directly by developing the photosensitive material of the present invention with a surface developer. The development by the surface developer is induced substantially by the latent images or fogging nuclei on the silver halide grain surface. Although the developer is preferably free from any silver halide solubilizer, the solubilizer (such as a sulfite) may be contained therein unless the internal latent image makes substantially no contribution to the development until the development by the surface development center of the silver halide grain has been completed.

The developer may contain, as an alkali or buffering agent, sodium hydroxide, potassium hydroxide, sodium carbonate, potassium carbonate, trisodium phosphate, sodium metaborate or the like. The amount of the agent is controlled so that the pH of the developer would be 10 to 13, preferably 11 to 12.5.

Advantageously, the developer contains a compound used usually as an antifoggant such as a benzimidazole, e.g. 5-nitrobenzimidazole or a benzotriazole compound, e.g. benzotriazole or 5-methylbenzotriazole, for lowering the minimum density of the direct positive image.

The following Examples are presented as a specific illustration of the invention. It should be understood, however, that the invention is not in any way limited to the specific details of the Examples.

EXAMPLE 1

Core/shell-type emulsions A and B were prepared as follows:

Emulsion A

An aqueous solution of potassium bromide and an aqueous solution of silver nitrate were added simultaneously to an aqueous gelatin solution under vigorous stirring at 40° C. in 20 min. to obtain a monodisperse silver bromide emulsion in which the grains were cubic and had an average grain diameter of 0.08 μm. Sodium thiosulfate and chloroauric acid (tetrahydrate) each in an amount of 580 mg per mol of silver were added to the emulsion and the mixture was heated at 75° C. for 80 min. to cause the chemical sensitization. The silver bromide grains thus obtained were used as the cores and these grains were grown under the same conditions as in the first precipitation step except that the pAg of the solution was controlled at 7.90, to finally obtain a monodisperse emulsion of core/shell-type cubic silver bromide grains having an average diameter of 0.18 μm. After washing with water followed by desalting, sodium thiosulfate and chloroauric acid (tetrahydrate), each in an amount of 6.2 mg per mol of silver, were added to the emulsion and the mixture was heated at 65° C. for 60 min., to conduct the chemical sensitization. Thus, Emulsion A was obtained.

Emulsion B

An aqueous potassium bromide solution and an aqueous silver nitrate solution were added simultaneously to an aqueous gelatin solution under vigorous stirring at 75° C. in about 40 min. to obtain a monodisperse emulsion of octahedral silver bromide grains having an average diameter of 0.4 μm. Sodium thiosulfate and chloroauric acid (tetrahydrate) each in an amount of 4 mg per mol of silver were added to the emulsion and the mixture was heated at 75° C. for 80 min. to conduct the chemical sensitization. The silver bromide grains thus obtained were used as the cores and were grown under the same conditions as in the first precipitation step for 40 min. to obtain a monodisperse emulsion of core/shell-type octahedral silver bromide grains having an average diameter of 0.6 μm. After washing with water followed by desalting, 0.9 mg, per mol of silver, of sodium thiosulfate was added to the emulsion and it was chemically sensitized by heating at 65° C. for 60 min., to obtain an internal latent image-type silver halide Emulsion B.

Emulsion C

An aqueous potassium bromide solution and an aqueous silver nitrate solution were added simultaneously to an aqueous gelatin solution under vigorous stirring at 40° C. in about 10 min. while the pAg was controlled at 7.9 by the control double jet method, so as to obtain an emulsion of cubic silver bromide grains having an average diameter of 0.05 μm. The emulsion was washed with water and desalted, but not chemically sensitized so as to obtain a negative Emulsion C.

Then, a sensitizing dye I was added to the core/shell-type emulsions A and B in amounts of 140 mg and 220 mg, respectively, per mol of silver. Further, 257 mg, per mol of silver, of anhydro-2-[3-(phenylhydrazolo)butyl]-3-(3-sulfopropyl)benzothiazolium hydroxide as a fogging agent was added to each of the emulsions.

A lower layer of Emulsion A and an upper layer of Emulsion B were made so that the amounts of the coated silver for the lower and upper layers are respectively 1.0 g/m$^2$ and 1.5 g/m$^2$ and that the amounts of the coated gelatin therefore are respectively 1.3 g/m$^2$ and 2.4 g/m$^2$. Then, a gelatin protective layer having a coated gelatin amount of 1.7 g was formed on the upper layer. In this process, sodium dodecylbenzenesulfonate was added as a coating aid in the emulsion layers and protective gelatin layer. Thus, Sample No. 1 was obtained.

Sample No. 2 was prepared in the same manner as in the preparation of Sample No. 1 except that an intermediate layer comprising 1.5 g/m$^2$ of gelatin was formed between the lower layer of Emulsion A and the upper layer of Emulsion B.

Sample No. 3 was prepared in the same manner as in the preparation of Sample No. 2, except that as an intermediate layer, Emulsion C which was not chemically sensitized was used so that the amount of coated Ag was 0.1 g/m$^2$.

The sensitizing dye I as used is as follows:

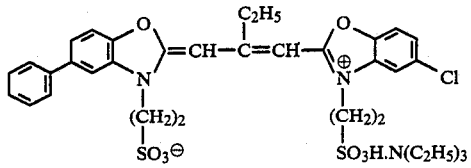

These samples were exposed to 1 kW tungsten light through a step wedge at a dye temperature of 2854° K. for 1 sec. Each of the samples was stirred in the following developer at 36° C. for 1 min. After the stopping followed by fixing and washing with water, a positive image was obtained.

| Developer | |
|---|---|
| hydroquinone | 45 g |
| sodium sulfite | 100 g |
| sodium carbonate | 20 g |
| sodium bromide | 3 g |
| 1-phenyl-4-methyl-4-hydroxymethyl-3-pyrazolidone | 3 g |
| 5-methylbenzotriazole | 40 mg |
| water ad | 1 l |

The pH of the developer was controlled at 11.8 with potassium hydroxide.

Granularity:

Granularity of transmission density of the developed sample a part of $(D_{max}+D_{min})/2$ was measured with a microdensitometer having a measuring aperture diameter of 24μ. The root mean square value (RMS) was calculated and the value was employed as the measure of the granularity. The larger the value, the rougher the grains. The criteria were as follows:

| RMS | Criteria |
|---|---|
| >0.04 | 1 |
| 0.036 to 0.04 | 2 |
| 0.032 to 0.036 | 3 |
| 0.028 to 0.032 | 4 |
| below 0.028 | 5 |

The black spot was evaluated by five criteria based on the observation with a microscope of 50x magnification. Criterion 5 was the best and Criterion 1 was the worst. Criterion 4 and 5 are usable. Criterion 3 is practically usable, although it is insufficient. Criteria 2 and 1 are practically useless.

The results are shown in Table 1.

TABLE 1

| | Granularity | Black Pepper |
|---|---|---|
| Sample No. 1 | 2 | 2 |
| No. 2 | 3 | 4 |
| No. 3 | 4 | 4 |

It is apparent from Table 1 that the black peppers were reduced and the granularity was improved remarkably by forming the intermediate layer comprising gelatin or both silver halide grains and gelatin.

EXAMPLE 2

Emulsion D was prepared as follows:

Emulsion D

An aqueous potassium bromide solution and an aqueous silver nitrate solution were added simultaneously to an aqueous gelatin solution under vigorous stirring at 45° C. in about 40 min. to obtain an emulsion of octahedral silver bromide grains having an average diameter of 0.2 μm. Each 5 mg, per mol of silver, of sodium thiosulfate and chloroauric acid (tetrahydrate) were added to the emulsion and the mixture was heated at 75° C. for 80 min., to conduct the chemical sensitization. The silver bromide grains thus obtained were used as the cores and were grown further under the same conditions as in the first precipitation step for 40 min., so as to obtain a monodisperse emulsion of core/shell-type octahedral silver bromide grains having an average diameter of 0.35 μm. Each 4.5 mg, per mol of silver, of sodium thiosulfate and chloroauric acid (tetrahydrate) were added to the emulsion and the emulsion was chemically sensitized by heating it at 65° C. for 60 min., so as to obtain an internal latent image-type silver halide Emulsion D.

(1) An antihalation layer comprising antihalation dyes A, B and C in coated amounts of 65, 80 and 40 mg/m$^2$, respectively, 5-methylbenzotriazole in a coated amount of 10 mg/m$^2$, and gelatin in a coated amount of 5 g/m$^2$; and (2) a protective layer (upper layer) comprising strontium barium sulfate having an average grain diameter of 1.0μ and polymethylmethacrylate having an average grain diameter of 1.3μ as matting agents, 30 mg/m$^2$ of a coating aid D, 1 mg/m$^2$ of an electrification-controlling agent, 100 mg/m$^2$ of a hardener F, and 1 g/m$^2$ of gelatin, were formed on an undercoated polyethylene terephthalate base having a thickness of 100μ so as to form a double back layer.

The compounds used in the Example are as follows:

Dye A

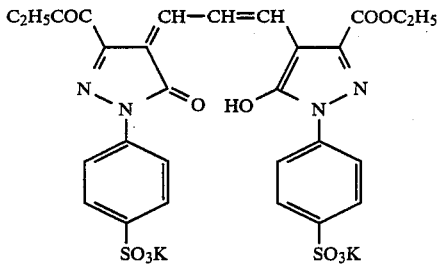

Dye B

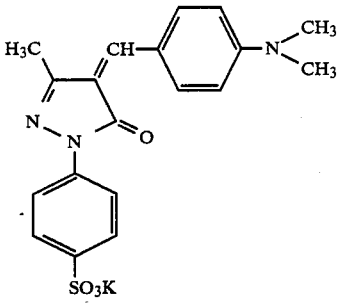

Dye C

-continued

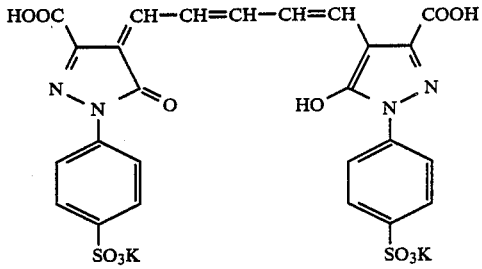

Coating aid D

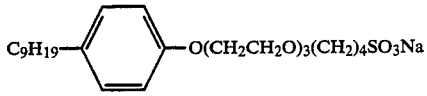

Electrification-controlling agent E $C_8F_{17}SO_3NCH_2COOK$
|
$C_3H_7$

Megafac F-120
(Produced by Dai Nippon Ink)

Hardener F $CH_2{=}CHSO_2CH_2CHCH_2SO_2CH{=}CH_2$
|
OH

Emulsion layers were coated on the opposite side of the support in respect to the back layer as follows.

Sample No. 4 was prepared in the same manner as in the preparation of Sample No. 3 except that Emulsion C was replaced with Emulsion D; that 200 mg, per mol of silver, of the sensitizing dye I was added to Emulsion D and 257 mg, per mol of silver, of anhydro-2-[3-(phenylhydrazolo)butyl]-3-(3-sulfopropyl)benzothiazolium hydroxide as the fogging agent was added thereto; and that a layer of Emulsion D comprising 0.8 g/m$^2$ of Ag and 1.3 g/m$^2$ of gelatin was formed between the lower layer of Emulsion A and the upper layer of Emulsion B.

The properties of Sample No. 4 are shown in Table 2.

The Sample No. 4 was excellent with respect to the positive gradation, black peppers and granularity.

TABLE 2

| Properties | |
|---|---|
| Gradient γ | 0.96 |
| $D_{max}$ | 2.95 |
| $D_{min}$ | 0.14 |
| Black Pepper | 4 |
| Granularity | 4 |

EXAMPLE 3

A multi-layered color photographic paper comprising a layer structure shown in Table 3 was prepared by applying the core/shell-type direct positive Emulsion A, B or D which were prepared in Examples 1 and 2 to the surface of a paper support, both surfaces of which had been laminated by polyethylene. The coating solution was prepared as follows.

Preparation of the coating solution for forming the first layer:

10 ml of ethyl acetate and 4 ml of a solvent (c) were added to 10 g of a yellow coupler (a) and 2.3 g of a color image dye stabilizer (b) to obtain a solution. The solution was emulsified in 90 ml of 10% aqueous gelatin solution containing 5 ml of a 10% sodium dodecylbenzenesulfonate. On the other hand, $2.0\times10^{-4}$ mol, per mol of silver bromide, of a blue sensitive dye shown below was added to the silver bromide emulsion B (containing 70 g/kg of Ag) to form 90 g of a blue sensitive emulsion. The two emulsions prepared as above were mixed together to obtain a solution. The concentration of the solution was controlled with gelatin so as to obtain a composition shown in Table I. $2\times10^{-4}$ mol, per mol of Ag, of a nucleating agent was added thereto to obtain the coating solution for forming the first layer.

Coating solutions for forming the second to seventh layers were prepared in the same manner as in the preparation of the first layer. Sodium salt of 1-hydroxy-3,5-dichloro-S-triazine was used as a hardener for gelatin in each layer.

The spectral sensitizers for the respective emulsion layers were as follows:

Blue-sensitive emulsion layer:

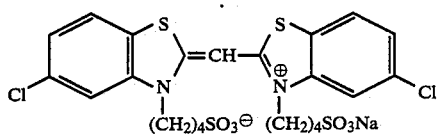

Green-sensitive emulsion layer:

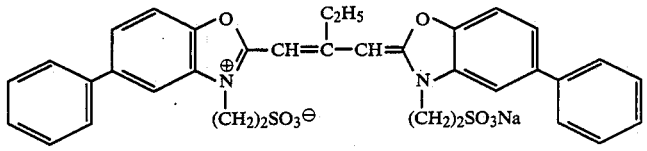

Red-sensitive emulsion layer:

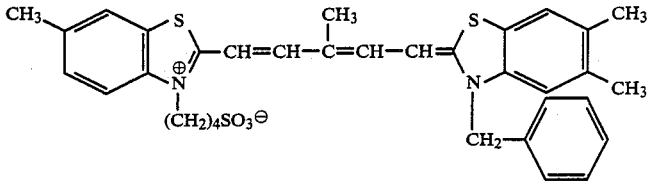

The anti-irradiation dyes for the respective emulsion layers were as follows:

Green-sensitive emulsion layer:

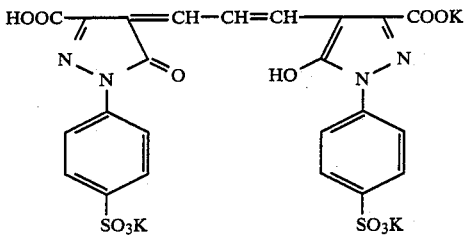

Red-sensitive emulsion layer:

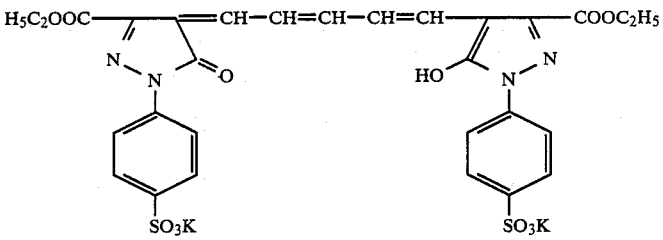

The structural formulae of the compounds such as couplers used in this example were as follows:

Yellow coupler:

-continued
(a)
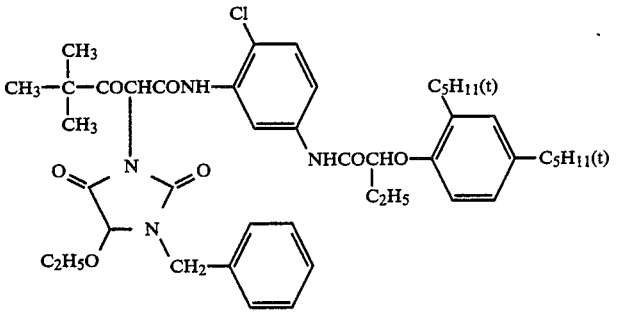
Image dye stabilizer:
(b)
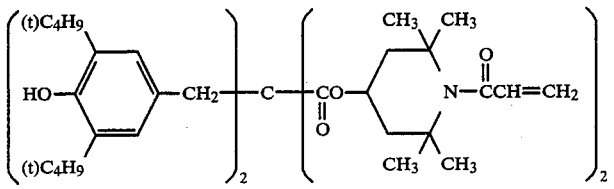
Solvent:
(c)
$(iso\text{-}C_9H_{19}O)_3P{=}O$
(d)
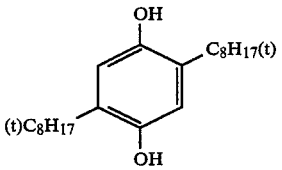
Magenta coupler:
(e)
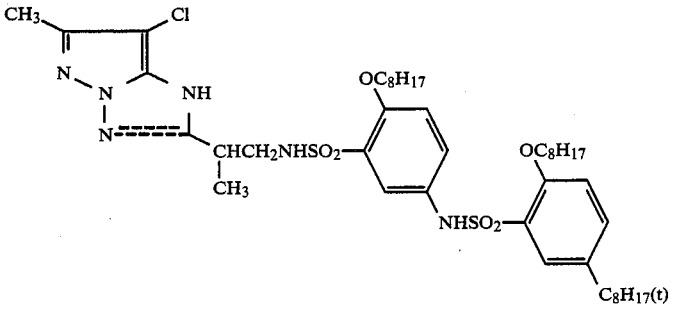
Image dye stabilizer:
(f)
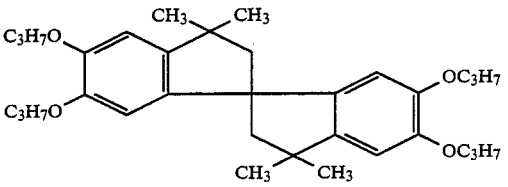
Solvent:
(g)
Mixture of $(n)\text{-}C_8H_{17}O)_3P{=}O$ and
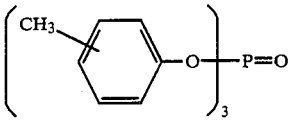
(weight ratio: 2:1)
U.V. absorber:

-continued
(h)
Mixture of
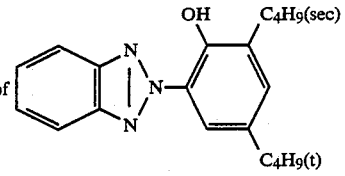
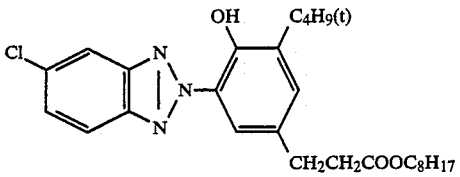
and
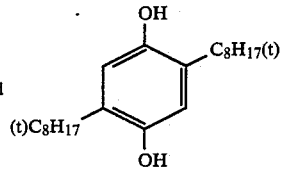
(molar ratio: 1:5:3)
Color mixing inhibitor:
(i)
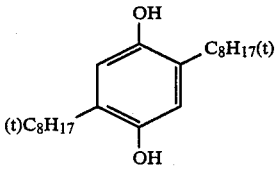
Solvent:
(j)
$(iso C_9H_{19}O)_3P{=}O$
Cyan coupler:
Mixture of
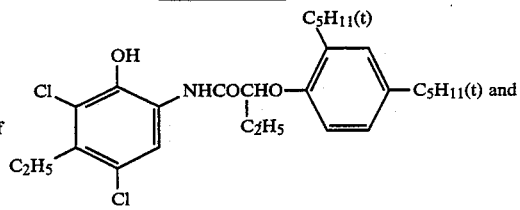
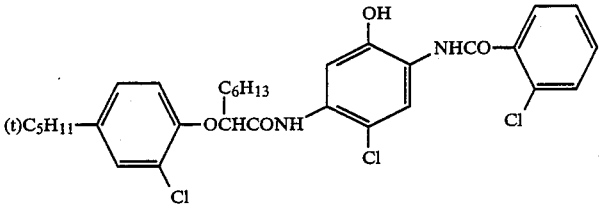
(molar ratio: 1:1)
Image dye stabilizer:
(l)
Mixture of
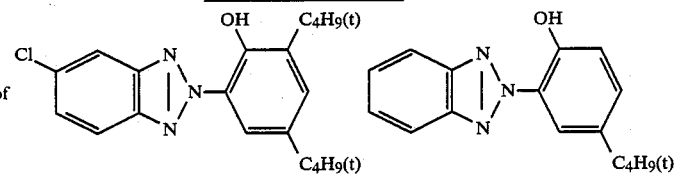
and
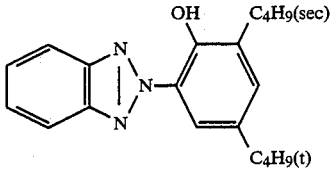
(molar ratio: 1:3:3)
Solvent:

-continued (m)

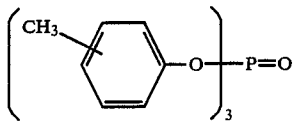

Nucleating agent:

(n)

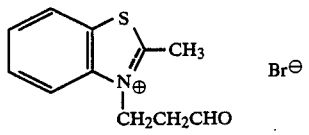

The balance between the surface tensions and viscosities of the coating solutions for forming the first to the seventh layers was controlled, and then the solutions were simultaneously applied to the support, to form a multi-layered silver halide color photosensitive material.

This photosensitive material was referred to as Sample 101.

Photosensitive materials (Sample Nos. 102 and 103) were also prepared in the same manner as the above except that modifications as shown in Tables 4 and 5 were made. Further, Sample No. 104 was also prepared in the same manner as the above except that Emulsion B to be used in the red-, green-and blue-sensitive layers was also changed to an emulsion mixture of Emulsion B with Emulsion A at a ratio of the former to the latter being 2:1. After subjecting the samples to the sensitometric gradation exposure with an enlarger (Fuji Color Head 609 by Fuji Photo Film Co., Ltd.), the samples were developed according to the following process:

| | Temperature (°C.) | Time (min.) |
|---|---|---|
| Processing step | | |
| Developing solution | 33 | 3.5 |
| Bleach-fixing solution | 33 | 1.5 |
| Washing with water | 28–35 | 3.0 |
| Developing solution | | |
| 3Na nitroilotriacetate | 2.0 g | |
| benzyl alcohol | 15 ml | |
| diethylene glycol | 10 ml | |
| $Na_2SO_3$ | 2.0 g | |
| KBr | 0.5 g | |
| hydroxylamine sulfate | 3.0 g | |
| 4-amino-3-methyl-N-ethyl-N-[β-methanesulfonamido)ethyl]-p-phenylenediamine sulfate | 5.0 g | |
| $Na_2CO_3$ (monohydrate) | 30 g | |
| water ad | 1 l (pH 10.1) | |
| Bleach-fixing solution | | |
| ammonium thiosulfate (70 wt. %) | 150 ml | |
| $Na_2SO_3$ | 15 g | |
| $NH_4[Fe(EDTA)]$ | 55 g | |
| EDTA·2Na | 4 g | |
| water ad | 1 l (pH 6.9) | |

TABLE 3

| Layer | Main Components | Amount |
|---|---|---|
| The seventh layer (protective layer) | gelatin | 1.33 g/m² |
| | acryl-modified polyvinyl alcohol copolymer (degree of modification: 17%) | 0.17 g/m² |
| The sixth layer (U.V.-absorbing layer) | gelatin | 0.54 g/m² |
| | U.V. absorber (h) | $5.10 \times 10^{-4}$ mol/m² |
| | solvent (j) | 0.08 g/m² |
| The fifth layer (red-sensitive layer) | silver bromide emulsion B silver: | 0.22 g/m² |
| | gelatin | 0.90 g/m² |
| | cyan coupler (k) | $7.05 \times 10^{4}$ mol/m² |
| | image dye stabilizer (l) | $5.20 \times 10^{4}$ mol/m² |
| | solvent (m) | 0.22 g/m² |
| | nucleating agent (n) | $4.1 \times 10^{-7}$ mol/m² |
| The fourth layer (U.V.-absorbing layer) | gelatin | 1.60 g/m² |
| | U.V. absorber (h) | $1.70 \times 10^{-4}$ mol/m² |
| | color mixing inhibitor (i) | $1.60 \times 10^{-4}$ mol /m² |
| | solvent (j) | 0.24 g/m² |
| The third layer (green-sensitive layer) | silver bromide emulsion B silver: | 0.11 g/m² |
| | gelatin | 1.56 g/m² |
| | magenta coupler (e) | $3.38 \times 10^{-4}$ mol/m² |
| | image dye stabilizer (f) | 0.19 g/m² |
| | solvent (g) | 0.59 g/m² |
| | nucleating agent (n) | $2.0 \times 10^{-7}$ mol/m² |
| The second layer (color mixing-inhibiting layer) | gelatin | 0.90 g/m² |
| | color mixing inhibitor (d) | $2.33 \times 10^{-4}$ mol/m² |
| The first layer (blue-sensitive layer) | silver bromide emulsion B silver: | 0.35 g/m² |
| | gelatin | 1.35 g/m² |
| | yellow coupler (a) | $6.91 \times 10^{-4}$ mol/m² |
| | image dye stabilizer (b) | 0.13 g/m² |
| | solvent (c) | 0.02 g/m² |
| | nucleating agent (n) | $6.5 \times 10^{-7}$ mol/m² |
| Support | Paper laminated with polyethylene (containing a white pigments such as $TiO_2$ and a blue dye such as ultramarine in the polyethylene layer adjacent to the first layer). | |

TABLE 4

| Layer | Main Components | Amount |
|---|---|---|
| The tenth layer (protective layer) | gelatin | 1.33 g/m² |
| | acryl-modified polyvinyl alcohol copolymer (degree of modification: 17%) | 0.17 g/m² |
| The ninth layer (U.V.-absorbing layer) | gelatin | 0.54 g/m² |
| | U.V. absorber (h) | $5.10 \times 10^{-4}$ mol/m² |
| | solvent (j) | 0.08 g/m² |
| The eighth layer (red-sensitive layer) | silver bromide emulsion B silver: | 0.15 g/m² |
| | gelatin | 0.61 g/m² |
| | cyan coupler (h) | $4.8 \times 10^{-4}$ mol/m² |
| | image dye stabilizer (l) | $3.5 \times 10^{-4}$ mol/m² |
| | solvent (m) | 0.15 g/m² |
| | nucleating agent (n) | $2.8 \times 10^{-7}$ mol/m² |
| The seventh layer (red-sensitive layer) | silver bromide emulsion A silver: | 0.07 g/m² |
| | gelatin | 0.29 g/m² |
| | cyan coupler (k) | $2.24 \times 10^{-4}$ mol/m² |

TABLE 4-continued

| Layer | Main Components | Amount |
|---|---|---|
| | image dye | $1.65 \times 10^{-4}$ mol/m$^2$ |
| | stabilizer (l) | |
| | solvent (m) | 0.07 g/m$^2$ |
| | nucleating agent (n) | $1.3 \times 10^{-7}$ mol/m$^2$ |
| The sixth layer (U.V.-absorbing layer) | gelatin | 1.60 g/m$^2$ |
| | U.V. absorber (h) | $1.70 \times 10^{-4}$ mol/m$^2$ |
| | color mixing inhibitor (i) | $1.60 \times 10^{-4}$ mol/m$^2$ |
| | solvent (j) | 0.24 g/m$^2$ |
| The fifth layer (green-sensitive layer) | silver bromide emulsion B silver: | 0.07 g/m$^2$ |
| | gelatin | 0.95 g/m$^2$ |
| | magenta coupler (e) | $2.15 \times 10^{-4}$ mol/m$^2$ |
| | image dye | 0.12 g/m$^2$ |
| | stabilizer (f) | |
| | solvent (g) | 0.38 g/m$^2$ |
| | nucleating agent (n) | $1.3 \times 10^{-7}$ mol/m$^2$ |
| The fourth layer (green-senstive layer) | silver bromide emulsion A silver: | 0.04 g/m$^2$ |
| | gelatin | 0.57 g/m$^2$ |
| | magenta coupler (e) | $1.23 \times 10^{-4}$ mol/m$^2$ |
| | image dye | 0.07 g/m$^2$ |
| | stabilizer (f) | |
| | solvent (g) | 0.21 g/m$^2$ |
| | nucleating agent (n) | $7.4 \times 10^{-8}$ mol/m$^2$ |
| The third layer (color mixing-inhibiting layer) | gelatin | 0.90 g/m$^2$ |
| | color mixing inhibitor (d) | $2.33 \times 10^{-4}$ mol/m$^2$ |
| The second layer (blue-sensitive layer) | silver bromide emulsion B silver: | 0.25 g/m$^2$ |
| | gelatin | 0.96 g/m$^2$ |
| | yellow coupler (a) | $4.9 \times 10^{-4}$ mol/m$^2$ |
| | image dye | 0.093 g/m$^2$ |
| | stabilizer (b) | |
| | solvent (c) | 0.014 g/m$^2$ |
| | nucleating agent (n) | $4.6 \times 10^{-7}$ mol/m$^2$ |
| The first layer (blue-sensitive layer) | silver bromide emulsion A silver: | 0.10 g/m$^2$ |
| | gelatin | 0.39 g/m$^2$ |
| | yellow coupler (a) | $1.97 \times 10^{-4}$ mol/m$^2$ |
| | image dye | 0.037 g/m$^2$ |
| | stabilizer (b) | |
| | solvent (c) | 0.006 g/m$^2$ |
| | nucleating agent (n) | $1.9 \times 10^{-7}$ mol/m$^2$ |
| Support | Paper laminated with polyethylene (containing a white pigment such as $TiO_2$ and a blue dye such as ultramarine in the polyethylene layer adjacent to the first layer) | |

TABLE 5

| Layer | Main Components | Amount |
|---|---|---|
| The thirteenth layer (protective layer) | gelatin | 1.33 g/m$^2$ |
| | acryl-modified polyvinyl alcohol copolymer (degree of modification: 17%) | 0.17 g/m$^2$ |
| The twelfth layer (U.V.-absorbing layer) | gelatin | 0.54 g/m$^2$ |
| | U.V. absorber (h) | $5.10 \times 10^{-4}$ mol/m$^2$ |
| | solvent (j) | 0.08 g/m$^2$ |
| The eleventh layer (red-sensitive layer) | silver bromide emulsion B silver: | 0.12 g/m$^2$ |
| | gelatin | 0.49 g/m$^2$ |
| | cyan coupler (k) | $3.85 \times 10^{-4}$ mol/m$^2$ |
| | image dye | $2.83 \times 10^{-4}$ mol/m$^2$ |
| | stabilizer (l) | |
| | solvent (m) | 0.12 g/m$^2$ |
| | nucleating agent (n) | $2.2 \times 10^{-4}$ mol/m$^2$ |
| The tenth layer (red-sensitive layer) | silver bromide emulsion D silver: | 0.06 g/m$^2$ |
| | gelatin | 0.25 g/m$^2$ |
| | cyan coupler (h) | $1.92 \times 10^{-4}$ mol/m$^2$ |
| | image dye | $1.42 \times 10^{-4}$ mol/m$^2$ |
| | stabilizer (1) | |
| | solvent (m) | 0.06 g/m$^2$ |
| | nucleating agent (n) | $1.1 \times 10^{-7}$ mol/m$^2$ |
| The ninth layer (green-sensitive layer) | silver bromide emulsion A silver: | 0.06 g/m$^2$ |
| | gelatin | 0.25 g/m$^2$ |
| | cyan coupler (k) | $1.92 \times 10^{-4}$ mol/m$^2$ |
| | image dye | $1.42 \times 10^{-4}$ mol/m$^2$ |
| | stabilizer (l) | |
| | solvent (m) | 0.06 g/m$^2$ |
| | nucleating agent (n) | $1.1 \times 10^{-7}$ mol/m$^2$ |
| The eighth layer (U.V.-absorbing layer) | gelatin | 1.60 g/m$^2$ |
| | U.V. absorber (h) | $1.70 \times 10^{-4}$ mol/m$^2$ |
| | color mixing inhibitor (i) | $1.60 \times 10^{-4}$ mol/m$^2$ |
| | solvent (j) | 0.24 g/m$^2$ |
| The seventh layer (green-sensitive layer) | silver bromide emulsion B silver: | 0.06 g/m$^2$ |
| | gelatin | 0.85 g/m$^2$ |
| | magenta coupler (e) | $1.84 \times 10^{-4}$ mol/m$^2$ |
| | image dye | 0.10 g/m$^2$ |
| | stabilizer (f) | |
| | solvent (g) | 0.32 g/m$^2$ |
| | nucleating agent (n) | $1.1 \times 10^{-7}$ mol/m$^2$ |
| The sixth layer (green-sensitive layer) | silver bromide emulsion D silver: | 0.03 g/m$^2$ |
| | gelatin | 0.43 g/m$^2$ |
| | magenta coupler (e) | $9.2 \times 10^{-5}$ mol/m$^2$ |
| | image dye | 0.05 g/m$^2$ |
| | stabilizer (f) | |
| | solvent (g) | 0.16 g/m$^2$ |
| | nucleating agent (n) | $5.5 \times 10^{-8}$ mol/m$^2$ |
| The fifth layer (green-sensitive layer) | silver bromide emulsion A silver: | 0.03 g/m$^2$ |
| | gelatin | 0.43 g/m$^2$ |
| | magenta coupler (e) | $9.2 \times 10^{-5}$ mol/m$^2$ |
| | image dye | 0.05 g/m$^2$ |
| | stabilizer (f) | |
| | solvent (g) | 0.16 g/m$^2$ |
| | nucleating agent (n) | $5.5 \times 10^{-8}$ mol/m$^2$ |
| The fourth layer (color mixing-inhibiting layer) | gelatin | 0.90 g/m$^2$ |
| | color mixing inhibitor (d) | $2.33 \times 10^{-4}$ mol/m$^2$ |
| The third layer (blue-sensitive layer) | silver bromide emulsion A silver: | 0.18 g/m$^2$ |
| | gelatin | 0.69 g/m$^2$ |
| | yellow coupler (a) | $3.55 \times 10^{-4}$ mol/m$^2$ |
| | image dye | 0.07 g/m$^2$ |
| | stabilizer (b) | |
| | solvent (c) | 0.01 g/m$^2$ |
| | nucleating agent (n) | $3.3 \times 10^{-7}$ mol/m$^2$ |
| The second layer (blue-sensitive layer) | silver bromide emulsion B silver: | 0.09 g/m$^2$ |
| | gelatin | 0.35 g/m$^2$ |
| | yellow coupler (a) | $1.78 \times 10^{-4}$ mol/m$^2$ |
| | image dye | 0.035 g/m$^2$ |
| | stabilizer (b) | |
| | solvent (c) | 0.005 g/m$^2$ |
| | nucleating agent (n) | $1.7 \times 10^{-7}$ mol/m$^2$ |
| The first layer (blue-sensitive layer) | silver bromide emulsion A silver: | 0.09 g/m$^2$ |
| | gelatin | 0.35 g/m$^2$ |
| | yellow coupler (a) | $1.78 \times 10^{-4}$ mol/m$^2$ |
| | image dye | 0.035 g/m$^2$ |
| | stabilizer (b) | |
| | solvent (c) | 0.005 g/m$^2$ |
| | nucleating agent (n) | $1.7 \times 10^{-7}$ mol/m$^2$ |
| Support | Paper laminated with polyethylene (containing a white pigment such as $TiO_2$ and a blue dye such as ultramarine in the polyethylene layer adjacent to the first layer) | |

The properties of the processed samples are shown in Table 6.

In this example, cyan, magenta and yellow spots were formed in the emulsion layers, which was different from the case where the black peppers were formed in the black-and-white photosensitive material. These color spots were judged according to the same criteria as in Example 1.

TABLE 6

| Sample | Gradation (γ) | Black pepper |
|---|---|---|
| 101 | 2.3 | 5 |
| 102 | 0.95 | 3 |
| 103 | 1.05 | 5 |
| 104 | 0.93 | 3 |

It is apparent from Table 6 that Sample 102 which had a dual layer structure for improving the gradation was inferior to Sample 101 in the spot property, and that the spot property was deteriorated even though Sample No. 104 was used, but that the present Sample 103 was improved in the spot property.

EXAMPLE 4

Preparation of core/shell-type direct positive emulsions

Emulsion E: p An aqueous potassium bromide solution and an aqueous silver nitrate solution were simultaneously added to an aqueous gelatin solution under vigorous stirring at 75° C. in about 60 min. to produce a silver bromide emulsion. 100 mg, per mol of silver, of 3,4-dimethyl-1,3-thiazoline-2-thion and 15 g, per mol of silver, of benzimidazole were added to a precipitation tank prior to precipitation. After completion of the precipitation, crystals having an average grain diameter of about 1.1 μm were formed. Then 5.4 mg, per mol of silver, of sodium thiosulfate and 3.9 mg, per mol of silver, of potassium chloroaurate were added to the silver bromide grains and the mixture was heated at 75° C. for 80 min. to conduct the chemical sensitization. The aqueous solutions of potassium bromide and silver nitrate were added simultaneously to the thus chemically sensitized core emulsion during 40 min. in the same manner as above, to produce a core/shell-type emulsion. The final average grain diameter was 1.5 μm.

Then, 0.32 mg, per mol of silver, of sodium thiosulfate and 57 mg, per mol of silver, of poly(n-vinylpyrrolidone) were added to the core/shell-type emulsion and the mixture was heated at 60° C. for 60 min. to conduct the chemical sensitization of the grain surfaces (Emulsion E).

Emulsion F

Equimolar amounts of aqueous solutions of potassium bromide and silver nitrate were mixed together at 75° C. in about 30 min. to produce a silver bromide emulsion having an average grain diameter of about 0.5 μm. Then, 3.5 mg, per mol of silver, of sodium thiosulfate, 5.4 mg, per mol of silver, of potassium chloroaurate and 0.8 mg, per mol of silver, of lead nitrate were added thereto and the mixture was heated at 75° C. for 60 min. to conduct the chemical sensitization. Simultaneous mixing was made to the thus chemically sensitized product under the same precipitation conditions as the above during 50 min., to further grow the silver halide grains. The final average grain diameter of the thus obtained silver halide grains was 0.8 μm [core/shell-type direct positive AgBr emulsion; Emulsion (B)].

Then, 0.6 mg, per mol of silver, of sodium thiosulfate, 0.20 mg, per mol of silver, of potassium chloroaurate, and 30 mg, per mol of silver, of poly(N-vinylpyrrolidone) were added to the core/shell-type emulsion and the mixture was heated at 60° C. for 60 min., to conduct the chemical sensitization of the grain surfaces (Emulsion F).

Emulsion G

Equimolar amounts of aqueous solutions of potassium bromide and silver nitrate were mixed together at 75° C. during about 40 min., to produce a silver bromide emulsion having an average grain diameter of about 0.6μ. Then, 2.7 mg, per mol of silver, of sodium thiosulfate, 3.6 mg, per mol of silver, of potassium chloroaurate, and 0.8 mg, per mol of silver, of lead nitrate were added thereto and the mixture was heated at 75° C. for 60 min., to conduct the chemical sensitization. The simultaneous mixing was made for the thus chemically sensitized product under the same precipitation conditions as the above for 50 min., so as to further grow the silver halide grains. The final average diameter of the thus obtained silver halide grains was 1.0 μm [core/shell-type direct positive AgBr emulsion; Emulsion (B)].

Then, 0.36 mg, per mol of silver, of sodium thiosulfate, 0.18 mg, per mol of silver, of potassium chloroaurate, and 42 mg, per mol of silver, of poly(N-vinylpyrrolidone) were added to the core/shell-type emulsion and the mixture was heated to 60° C. for 60 min., to effect the chemical sensitization of the grain surfaces (emulsion G).

Layers (1) to (21) shown below were formed on a transparent polyethylene terephthalate support to form a photosensitive sheet 201 having the following layer structure:

| | |
|---|---|
| Layer (21) | Protective layer containing gelatin |
| Layer (20) | U.V.-absorbing layer |
| Layer (19) | Blue-sensitive core/shell-type direct positive emulsion layer |
| Layer (18) | Blue-sensitive core/shell-type direct positive emulsion layer 2 |
| Layer (17) | White light-reflecting layer |
| Layer (16) | Layer containing a yellow DRR compound |
| Layer (15) | Intermediate layer containing gelatin |
| Layer (14) | Color mixing-inhibiting layer |
| Layer (13) | Green-sensitive core/shell-type direct positive emulsion layer |
| Layer (12) | Green-sensitive core/shell-type direct positive emulsion layer 2 |
| Layer (11) | White light-reflecting layer |
| Layer (10) | Layer containing a magenta DRR compound |
| Layer (9) | Intermediate layer containing gelatin |
| Layer (8) | Color mixing-inhibiting layer |
| Layer (7) | Red-sensitive core/shell-type direct positive emulsion layer |
| Layer (6) | Red-sensitive core/shell-type direct positive emulsion layer 2 |
| Layer (5) | White light-reflecting layer |
| Layer (4) | Layer containing a cyan DRR compound |
| Layer (3) | Sun-proofing layer |

-continued

| | |
|---|---|
| Layer (2) | White light-reflecting layer |
| Layer (1) | Mordant layer |

Note:

Layer (1): A mordant layer containing 3.0 g/m$^2$ of a copolymer having the following recurring units at the following rates, which is disclosed in U.S. Pat. No. 3,898,088; and 3.0 mg/m$^2$ of gelatin

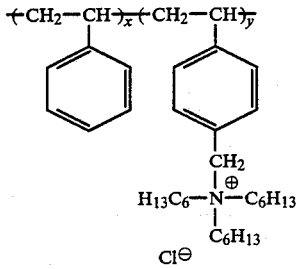

x:y = 50:50

Layer (2): A white light-reflecting layer containing 2.0 g/m$^2$ of titanium oxide and 2.0 g/m$^2$ of gelatin Layer (3): A sun-proofing layer containing 2.0 g of carbon black and 1.5 g/m$^2$ of gelatin Layer (4): A layer containing 0.44 g/m$^2$ of the following cyan DRR compound, 0.09 g/m$^2$ of tricyclohexyl phosphate, and 0.8 g/m$^2$ of gelatin

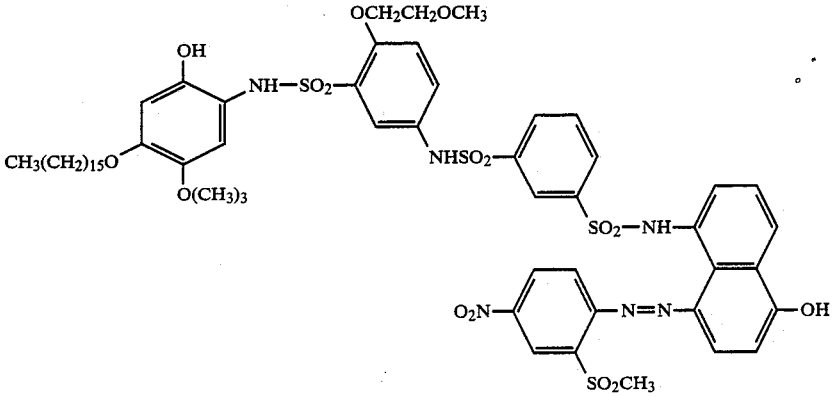

Layer (5): A white light-reflecting layer containing 2.8 g/m$^2$ of titanium oxide and 1.0 g/m$^2$ of gelatin Layer (6): A red-sensitive core/shell-type direct positive silver bromide emulsion layer containing Emulsion E (1.0 g/m$^2$ in terms of silver), the following red-sensitive sensitizing dye, 0.018 mg/m$^2$ of the compound used in Example 1 as the following nucleating agent, 5.3 mg/m$^2$ of 4-hydroxy-6-methyl-1,3,3a-tetrazaindene, and 0.12 g/m$^2$ of sodium 5-pentadecylhydroquinone-2-sulfonate Red-sensitive sensitizing dye:

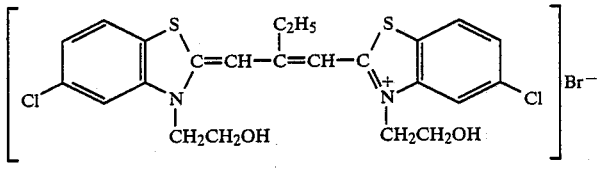

Nucleating agent:

-continued

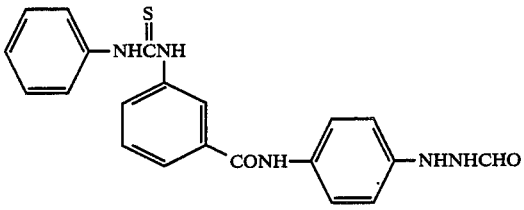

Layer (7): A red-sensitive core/shell-type direct positive silver bromide emulsion layer containing Emulsion F (0.27 g/m$^2$ in terms of silver), 0.04 mg/m$^2$ of the same red-sensitive sensitizing dye as that of Layer (6), 0.005 mg/m$^2$ of the same nucleating agent as that of Layer (6), 1.4 mg/m$^2$ of 4-hydroxy-6-methyl-1,3,3a-tetrazaindene, and 0.03 g/m2 of sodium 5-pentadecylhydroquinone-2-sulfonate Layer (8): A color mixing-inhibiting layer containing 1.0 g/m$^2$ of 2,5-di-t-pentadecylhydroquinone and 0.8 g/m$^2$ of gelatin Layer (9): An intermediate layer containing 0.18 g/m$^2$ of gelatin Layer (10): A layer containing 0.21 g/m$^2$ of the magenta DRR compound of the following structural formula I, 0.11 g/m$^2$ of magenta DRR compound of the following structural formula II, 0.08 g/m$^2$ of tricyclohexyl phosphate, and 0.9 g/m$^2$ of gelatin:

Structural formula I:

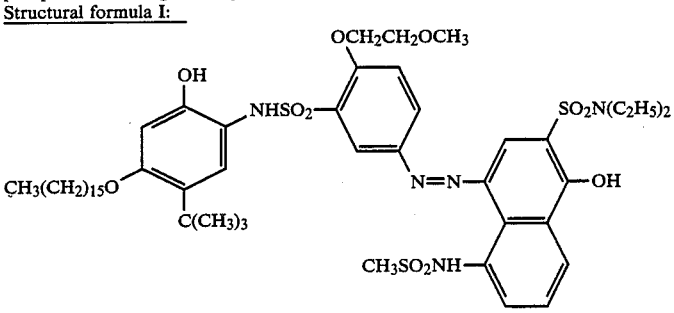

Structural formula II:

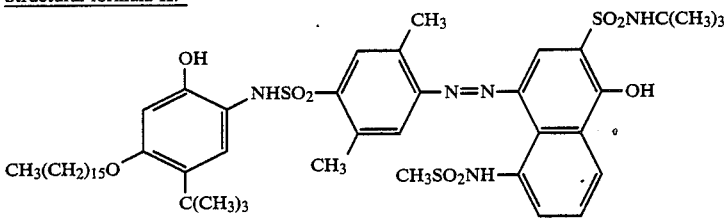

Layer (11): A white light-reflecting layer containing 1.0 g/m$^2$ of titanium oxide and 0.36 g/m$^2$ of gelatin Layer (12): A green-sensitive core/shell-type direct positive silver bromide emulsion layer containing Emulsion E (0.55 g/m$^2$ in terms of silver), 0.12 mg/m$^2$ of the following green-sensitive sensitizing dye, 0.008 g/m$^2$ of the same nucleating agent (the compound of layer (6) as that of Layer (6), 3.2 mg/m$^2$ of 4-hydroxy-6-methyl-1,3,3a-tetrazaindene, and 0.07 g/m$^2$ of sodium 5-pentadecylhydroquinone-2-sulfonate:

Green-sensitive sensitizing dye:

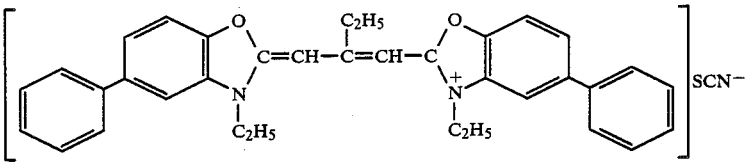

Layer (13): A green-sensitive core/shell-type direct positive emulsion layer containing Emulsion F (0.15 g/m$^2$ in -continued terms of silver), 0.03 mg/m$^2$ of the same green-sensitive sensitizing dye as that of layer (12), 0.002 g/m$^2$ of the same nucleating agent as that of Layer (12), 0.21 mg/m$^2$ of 4-hydroxy-6-methyl-1,3,3a-tetrazaindene, and 0.02 g/m$^2$ of sodium 5-pentadecylhydroquinone-2-sulfonate Layer (14): The same layer as Layer (7)

Layer (15): The same layer as Layer (8)

Layer (16): A layer containing 0.53 g/m$^2$ of the following yellow DRR compound, 0.13 g/m$^2$ of tricyclohexyl phosphate, and 0.7 g/m$^2$ of gelatin

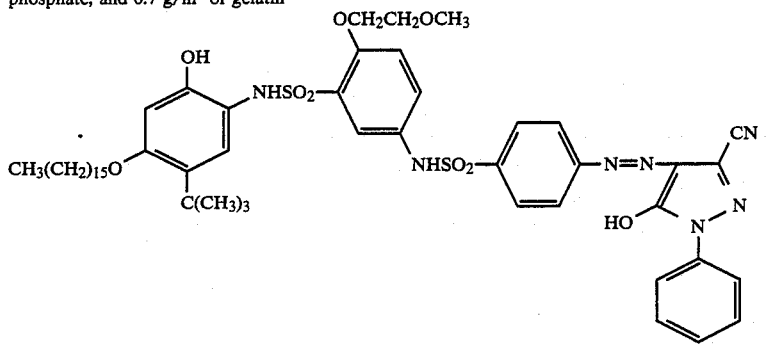

Layer (17): A light-reflecting layer containing 0.6 g/m$^2$ of titanium oxide and 0.21 g/m$^2$ of gelatin Layer (18): A blue-sensitive core/shell-type direct positive silver bromide emulsion layer containing Emulsion E (1.00 g/m$^2$ in terms of silver), 0.020 mg/m$^2$ of the same nucleating agent as that of Layer (6), 4.1 mg/m$^2$ of 4-hydroxy-6-methyl-1,3,3a-tetrazaindene, and 0.06 g/m$^2$ of sodium 5-pentadecylhydroquinone-2-sulfonate Layer (19): A blue-sensitive core/shell-type direct positive silver bromide emulsion layer containing Emulsion F (0.27 g/m$^2$ in terms of silver), 0.005 mg/m$^2$ of the same nucleating agent as that of Layer (6), 1.1 mg/m$^2$ of 4-hydroxy-6-methyl-1,3,3a-tetrazaindene, and 0.015 g/m$^2$ of sodium 5-pentadecylhydroquinone-2-sulfonate Layer (20): A U.V.-absorbing layer containing 4 × 10−4 mol/m$^2$ of each of the following U.V. absorbers and 0.50 g/m$^2$ of gelatin:

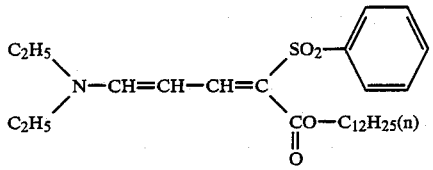

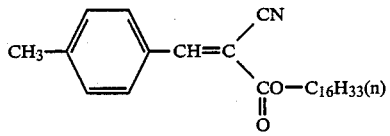

Layer (21): A protective layer containing 0.10 g/m$^2$ of polymethylmethacrylate latex (average grain size: 4 μ), 0.8 g/m$^2$ of gelatin, and 0.02 g/m$^2$ of triacryloyltriazine as a hardener.

Cover sheet:

A cover sheet was prepared by forming the following layers (1) to (3) successively on a transparent polyethylene terephthalate support:

Layer (1): A neutralization layer containing 22 g/m$^2$ of acrylic acid/butyl acrylate copolymer (monomer weight ratio: 80/20) and 0.44 g/m$^2$ of 1,4bis(2,3-epoxypropoxy)butane Layer (2): A layer containing 3.8 g/m$^2$ of acetylcellulose (100 g of the acetylcellulose was hydrolyzed to form 39.4 g of acetyl groups), 0.2 g/m$^2$ of styrene/maleic anhydride copolymer (monomer weight ratio: 60/40) having a molecular weight of about 50,000, and 0.115 g/m$^2$ of 5-(βcyanoethylthio)-1-phenyltetrazole Layer (3): A layer containing 2.5 g/m$^2$ of a copolymer latex comprising vinylidene chloride, methyl acrylate and acrylic acid, in a weight ratio of 85/12/3, and 0.05 g/m² of polymethyl methacrylate latex (grain diameter: 1 to 3 μm).

| Processing solution: | |
|---|---|
| 1-p-tolyl-4-methyl-4-hydroxymethyl-3-pyrazolidone | 12.0 g |
| methylhydroquinone | 0.3 g |
| 5-methylbenzotriazole | 3.5 g |
| sodium sulfite | 2.0 g |
| Na salt of carboxymethylcellulose | 58 g |
| potassium hydroxide | 56 g |
| benzyl alcohol | 1.5 g |
| carbon black dispersion (25%) | 600 g |
| water ad | 1 kg |

Processing solution:

0.8 g of the processing solution having the abovementioned composition was charged in each of "containers breakable by compression".

Exposure and development:

The cover sheet and sensitive sheet prepared as mentioned above were put together and was exposed from the cover sheet side through a continuous tone wedge. Then, the abovementioned processing solution was spread between the two sheets by means of a pressure roller at 25° C. so that the thickness of the solution was 75 μm.

Then, a photosensitive sheet was prepared in the same manner as in the preparation of the photosensitive sheet 201 except that the following emulsion layers 6a, 12a and 18a were added as follows, to form a photosensitive sheet 202.

Layer (6a): A red-sensitive core/shell-type direct positive silver bromide emulsion layer interposed between Layers (6) and (7) and containing Emulsion G (0.10 g/m² in terms of silver), 0.015 mg/m² of the same red-sensitive sensitizing dye as that of Layer (7), 0.002 mg/m² of the same nucleating agent as that of Layer (7), 0.5 mg/m² of 4-hydroxy-6-methyl-1,3,3a-tetrazaindene, and 0.01 g/m² of sodium 5-pentadecylhydroquinone-2-sulfonate Layer (12a): A green-sensitive core/shell-type direct positive silver bromide emulsion later interposed between Layers (12) and (13), and containing Emulsion G (0.10 g/m² in terms of silver), 0.015 mg/m² of the same green-sensitive sensitizing dye as that of Layer (12), 0.001 mg/m² of the same nucleating agent as that of Layer (12), 0.4 mg/m² of 4-hydroxy-6-methyl-1,3,3a-tetrazaindene and 0.01 g/m² of sodium 5-pentadecylhydroquinone-2-sulfonate.

Layer (18a): A blue-sensitive core/shell-type direct positive silver bromide emulsion layer interposed between Layers (18) and (19), and containing Emulsion G (0.10 g/m² in terms of silver), 0.003 mg/m² of the same nucleating agent as that of Layer (6), 0.5 mg/m² of 4-hydroxy-6-methyl-1,3,3a-tetrazaindene, and 0.007 g/m² of sodium 5-pentadecylhydroquinone-2-sulfonate.

The results are shown in table 7. The granularity was evaluated by visual observation according to the following criteria:

Ranks:

A: No grains are recognized at all.

B: Grains are recognized, but the material is practically usable.

C: Grains are recognized, so that the material is not practically usable.

TABLE 7

| Photosensitive material sheet | Granularity |
|---|---|
| 201 | B |
| 202 | A |

It is apparent that Sheet 202 of the present invention had an improved granularity.

EXAMPLE 5

Sample Nos. 1a, 1b and 1c were prepared in the same manner as in the preparation of Sample No. 1 in Example 1 except that a fogging agent shown in Table 8 was added in an amount shown in Table 8. Sample Nos. 2a, 2b and 2c and Sample Nos. 3a, 3b and 3c were prepared from Sample Nos. 2 and 3, respectively in the same manner as above. After the treatment carried out in the same manner as in Example 1, the properties of them were evaluated in the same manner as in Example 1. The results are shown in Table 9.

Fogging agent (a)

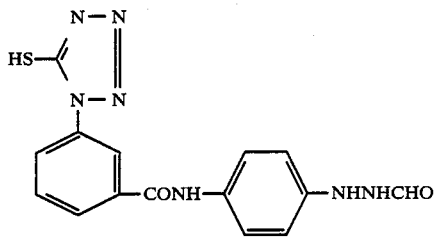

(b)

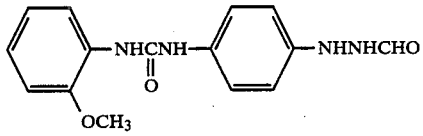

(c)

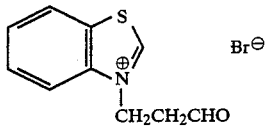

TABLE 8

| Sample No. | Coating solution | Fogging agent | Amount of the fogging agent (mg) per mol of Ag: Upper layer | Lower layer |
|---|---|---|---|---|
| 1a | the same as No. 1 except the fogging agent | (a) | 40 | 60 |
| 1b | the same as No. 1 except the fogging agent | (b) | 340 | 340 |
| 1c | the same as No. 1 except the fogging agent | (c) | 60 | 60 |
| 2a | the same as No. 2 except the fogging agent | (a) | 40 | 60 |
| 2b | the same as No. 2 except the fogging agent | (b) | 340 | 340 |
| 2c | the same as | (c) | 60 | 60 |

TABLE 8-continued

| Sample No. | Coating solution | Fogging agent | Amount of the fogging agent (mg) per mol of Ag | |
|---|---|---|---|---|
| | | | Upper layer | Lower layer |
| | No. 2 except the fogging agent | | | |
| 3a | the same as No. 3 except the fogging agent | (a) | 40 | 60 |
| 3b | the same as No. 3 except the fogging agent | (b) | 340 | 340 |
| 3c | the same as No. 3 except the fogging agent | (c) | 60 | 60 |

TABLE 9

| Sample | Granularity | Black peppers |
|---|---|---|
| No. 1a | 2 | 2 |
| 1b | 2 | 2 |
| 1c | 1 | 2 |
| 2a | 4 | 4 |
| 2b | 3 | 3 |
| 2c | 3 | 3 |
| 3a | 4 | 4 |
| 3b | 4 | 4 |
| 3c | 3 | 4 |

It is apparent that the effects of the present invention are unchanged even when the fogging agent to be used is changed.

EXAMPLE 6

The same back layer as in Example 2 was formed on the same support as in Example 2. Sample Nos. 4a, 4b and 4c were prepared in the same manner as Example 2 except that the variety and the amount of a fogging agent to be used were changed as shown in Table 10 .

TABLE 10

| Sample No. | Fogging agent | Amount of fogging agent (mg) per mol of Ag | | |
|---|---|---|---|---|
| | | Upper layer | Intermediate layer | Lower layer |
| 4a | a | 40 | 40 | 60 |
| 4b | b | 340 | 340 | 340 |
| 4c | c | 60 | 60 | 60 |

The results are shown in Table 11.

TABLE 11

| Properties | Sample No. | | |
|---|---|---|---|
| | 4a | 4b | 4c |
| Gradation $\gamma$ | 1.01 | 0.97 | 0.94 |
| $D_{max}$ | 2.99 | 3.02 | 2.85 |
| $D_{min}$ | 0.14 | 0.14 | 0.14 |
| Black peppers | 4 | 4 | 4 |
| Granularity | 4 | 4 | 4 |

The samples had excellent properties like those of Example 2.

Although the invention has been described above in terms of preferred embodiments, it is to be understood that variations and modifications thereto may be made, as will be apparent to those skilled in the art. Such variations and modifications are to be considered within the purview and scope of the claims appended hereto.

What is claimed is:

1. A direct positive photographic light-sensitive material comprising, on a support, at least two previously unfogged internal latent image-type direct positive silver halide emulsion layers having the same color sensitivity, wherein at least one hydrophilic colloid layer containing a binder is provided between said emulsion layers, and wherein said hydrophilic colloid layer is not a previously unfogged internal latent image-type direct positive emulsion layer which contains smaller size grains. having diameters ranging from about 0.1 to about 0.5 μms.

2. A photographic light-sensitive material according to claim 1, wherein said direct positive emulsion layer is a direct positive emulsion layer containing core/shell-type silver halide grains.

3. A photographic light-sensitive material according to claim 2, wherein said core/shell-type silver halide grains are prepared by forming a silver halide core which has been chemically sensitized and/or doped with a metal ion, coating the core with a silver halide to form the shell, and then chemically sensitizing said shell.

4. A photographic light-sensitive material according to claim 1, wherein the silver halide grains contained in the emulsion layer are monodispersed.

5. A photographic light-sensitive material according to claim 4, wherein the silver halide grains contained in the emulsion layer have an average grain diameter of about 0.1 to 4 μm.

6. A photographic light-sensitive material according to claim 5, wherein said average grain diameter is about 0.2 to 3 μm.

7. A photographic light-sensitive material according to claim 4, wherein 90% of the silver halide grains contained in the emulsion layer have a grain diameter within said average grain diameter ±40%.

8. A photographic light-sensitive material according to claim 7, wherein 90% of the silver halide grains contained in the emulsion layer have a grain diameter within said average grain diameter ±30%.

9. A photographic light-sensitive material according to claim 1, wherein two emulsion layers are provided on said support, and wherein the emulsion layer adjacent to said support contains smaller silver halide grains while the emulsion layer remote from said support contains larger silver halide grains.

10. A photographic light-sensitive material according to claim 1, wherein said binder is gelatin or a water-soluble polymer.

11. A photographic light-sensitive material according to claim 10, wherein said binder is gelatin.

12. A photographic light-sensitive material according to claim 1, wherein said hydrophilic colloid layer is formed so that the amount of the coated binder is 0.05 to 2 g/m$^2$.

13. A photographic light-sensitive material according to claim 12, wherein said hydrophilic colloid layer is formed so that the amount of the coated binder is 0.1 to 0.5 g/m$^2$.

14. A photographic light-sensitive material according to claim 1, wherein said hydrophilic colloid layer contains silver halide grains.

15. A photographic light-sensitive material according to claim 14, wherein the silver halide emulsion contained in said hydrophilic colloid layer is a negative or direct positive emulsion.

16. A photographic light-sensitive material according to claim 15, wherein said silver halide emulsion contained in said hydrophilic colloid layer is a direct positive emulsion.

* * * * *